US006086325A

United States Patent [19]

Ellinghaus

[11] Patent Number: 6,086,325

[45] Date of Patent: Jul. 11, 2000

[54] SIDE CHANNEL MACHINE

[75] Inventor: Wolfgang Ellinghaus, Gerlinger, Germany

[73] Assignee: Durr Dental GmbH & Co KG, Germany

[21] Appl. No.: 08/975,785

[22] Filed: Nov. 21, 1997

[30] Foreign Application Priority Data

Nov. 29, 1996 [DE] Germany ..... 196 49 529

[51] Int. Cl.[7] ..... F04D 5/00

[52] U.S. Cl. ..... 415/55.4; 415/55.1; 415/55.2

[58] Field of Search ..... 415/55.1, 55.2, 415/55.3, 55.4, 55.5, 55.6, 55.7

[56] References Cited

U.S. PATENT DOCUMENTS

| | | | |
|---|---|---|---|
| 3,356,033 | 12/1967 | Ullery | 415/55.4 |
| 4,793,766 | 12/1988 | Kumata | 415/55.1 |
| 5,295,784 | 3/1994 | Grotz | 415/55.6 |

*Primary Examiner*—Edward K. Look
*Assistant Examiner*—Richard Woo

[57] ABSTRACT

To improve the efficiency of a side channel suction machine, it is proposed to provide in the inlet regions of the side channels a smooth deflecting wall, which extends from the base of the side channel to the end face of the housing part in which the side channel is formed. The deflecting wall is inclined with respect to a radius line passing through its centre, preferably through about 40°.

27 Claims, 7 Drawing Sheets

SIDE CHANNEL MACHINE

BACKGROUND OF THE INVENTION

The invention relates to a side channel machine.

DE 4128 150 A1 discloses a side channel machine having a rotating disc shaped impeller in which at least one of the end faces a plurality of recesses distributed circumferentially on a common graduated circle is constructed, having a housing, which comprises a working chamber receiving the impeller, wherein in end walls of the working chamber of opposing the recesses of the impeller there are formed side channels covering over the tracks of the recesses of the impeller, which side channels have an angular extent of less than 360°, do that between the end sections of the side channels there remain webs, and wherein each of the end sections of the side channels is connected to an inlet channel. It is intended in particular for use in dentistry.

SUMMARY OF THE INVENTION

The present invention is intended to develop such a side channel machine so that it operates with even greater efficiency.

That problem is solved according to the invention with a side channel machine having a rotating disc shaped impeller in which in at least one of the end faces a plurality of recesses distributed circumferentially on a common graduated circle is constructed, having a housing, which comprises a working chamber receiving the impeller, wherein in end walls of the working chamber of opposing the recesses of the impeller there are formed side channels covering over the tracks of the recesses of the impeller, which side channels have an angular extent of less than 360°, so that between the end sections of the side channels there remain webs, and wherein each of the end sections of the side channels is connected to an inlet channel, the side channel machine also having a deflecting element that is asymmetrical with respect to the graduated circle of the recesses of the impeller and is arranged in the inlet side end section at least one of the side channels.

With the side channel machine according to the invention, a deflecting element that is asymmetrical with respect to the graduated circle is built into the inlet side end section of the side channel. Such a deflecting element unexpectedly enables the gas that is to be conveyed to be channelled more effectively, so that both the partial vacuum that can be produced with the side channel machine and the efficiency of the machine are improved.

The improved efficiency of the side channel machine according to the invention is doubtless attributable to the fact that the asymmetrical deflecting element imposes a radial component of motion on the fluid to be conveyed right at the start of the side channel, so that the fluid enters more quickly into the helical toroidal (helix with circular centre line) flow configuration pattern typical of a side channel machine.

With the side channel machine of the invention as described above, in the inlet side end section of the side channel there is a barrier that prevents the gas from flowing circumferentially and thus progressively forces the gas out of the side channel into the recesses of the impeller.

The deflecting element can be a deflecting wall running perpendicular to the surface of the working chamber end wall. The deflecting wall can run to the base of the side channel. The end face of the deflecting wall can be laid into the surface of the working chamber end wall. These developments are advantageous with regard to an especially effective blocking of an initially rather laminar circumferential flow of gas in the side channel.

The deflecting wall can be set up obliquely with respect to a radius line and can be substantially uniform at least in a main portion. This causes a continuous channelling of the gas flow into a helical toroidal circumferential gas flow.

The radially inner section of the obliquely set deflecting wall can be concavely curved as seen in the direction of rotation of the impeller. This is advantageous with regard to an enlargement of the volumetric flow.

The deflecting wall can form an angle of incidence of about 20° to about 50° with a radius line passing through its center, the radially outer end of the deflecting wall lying in front of the radially inner end, as seen in the direction of rotation. This is also advantageous with regard to an enlargement of the volumetric flow.

The above angles of incidence, more preferably angles of incidence lying between 30° and 45°, preferably at about 35° to about 40° have proved especially successful for an increase in the partial vacuum that can be generated with the side channel machine and for an improvement in efficiency.

The total circumferential extent of the deflecting wall can correspond to the circumferential extent of a plurality of recesses of the impeller. This ensures that enforced channelling of the gas flow into a flow having a radial component of movement is effected over a distance corresponding to a plurality of recesses of the impeller. This is advantageous with regard to a careful, effective channelling associated with little noise.

The above advantages are obtained in particular when the circumferential extent of the deflecting wall corresponds substantially to the circumferential extent of two distinct recesses of the impeller, preferably to the circumferential extent of the three recesses of the impeller. The total circumferential extent of the deflecting wall also can correspond to the circumferential extent of 2 to 6 recesses of the impeller.

The deflecting wall can have a small thickness compared to the circumferential extent of a recess of the impeller. The thickness of the deflecting wall can correspond substantially to the thickness of the compressible heads of the impeller lying between adjacent recesses. This development promotes channelling of the gas to be conveyed from the direction of inflow into a helical flow that is effective yet free from unnecessary eddy formation.

The inlet side ends section of at least one of the side channels can be connected to an inlet chamber and, furthermore can be connected to the end face of the impeller by way of a connecting aperture that is formed in a working chamber end wall, a circumferentially running part of the connecting aperture can be roofed over by a circumferentially running deflecting wall.

The deflecting wall can be in the form of a segment of a truncated cone that is connected at its base surface to the end of the side channel wall. The radial extent of the deflecting wall can correspond approximately to half the radial extent of the connecting aperture. The deflecting wall can be closed at its end remote from the end of the side channel. There can be connected to the free longitudinal edge of the deflecting wall a second deflecting wall which approximately follows the graduated circle of recesses and stands perpendicular to the plane of the working chamber in the wall. The impeller side end face of the second deflecting wall can be laid right into the plane of the working chamber end wall. A marginal aperture can be provided in the trailing end of the second deflecting wall seen in the direction of rotation. The inlet side end of the side channel can be formed by a semi-cylindrical wall drawn into the inlet chamber and in the portion not joined to the deflecting wall this wall can have an end face that recedes in the direction of rotation from the apex line of the side channel to the edge thereof. The inlet aperture can be substantially in the form of a rectangle with its long axis running in the direction of rotation. Each of the details specified above being advantageous with regard to further improvement of the partial vacuum that can be created with the side channel machine and of the efficiency of the side channel machine.

Each of the webs remaining between the end sections of the side channels can have an angular extent of 20° to about 40°, preferably of about 30° so that the side channels correspondingly have an angular extent of 340° to 320°, preferably about 330°. This has the advantages that firstly, the seal between the inlet side end section and the outlet side end section of the side channels is still adequate, and secondly, the circumferential extent of the side channels is large, which is advantageous with regard to further improvement in the efficiency of the side channel machine.

DESCRIPTION OF PREFERRED EMBODIMENTS

Figure 1:
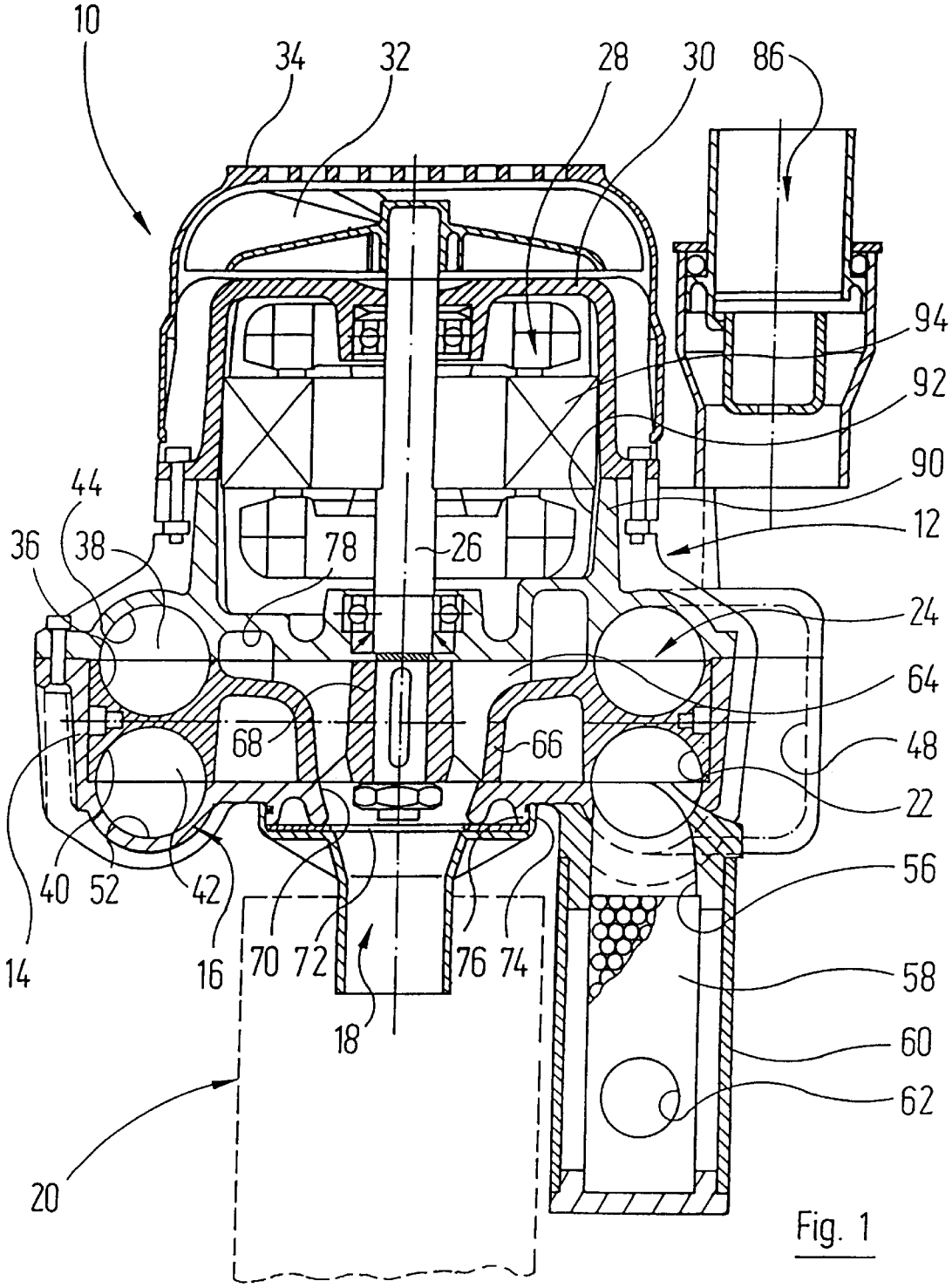
FIG. 1 is an axial section through a two-stage side channel suction machine having an inlet aperture lying on the housing axis and an additional inlet side precompressor and channelling stage that is integrated into the impeller.

The drawings show a side channel suction machine denoted generally by the reference numeral 10, for dental use, having a housing that comprises an upper housing part 12 and a bowl-shaped lower housing part 16 having a circumferential wall. The latter housing part carries a central inlet connector 18, which is connected to the outlet of a separator unit, indicated merely by a broken line at 20. The latter separates liquid and solid constituents from the air emerging from the dentist's work station, so that only dry air is admitted to the suction machine 10.

The housing parts 12 and 16 together bound a pump chamber 22 in which an impeller 24 rotates.

The impeller 24 is overhung on the end of a motor shaft 26, which belongs to an electric motor 28 disposed at the top end of the upper housing part 12. The upper motor casing part of the motor is denoted by the reference number 30. An upper end portion of the motor shaft 26 carries a fan impeller 32. An external housing 34, which guides the air current generated by the fan impeller 32 over the outer surface of the motor casing part 30, is placed on radial ribs of the motor casing part 30.

Figure 5:
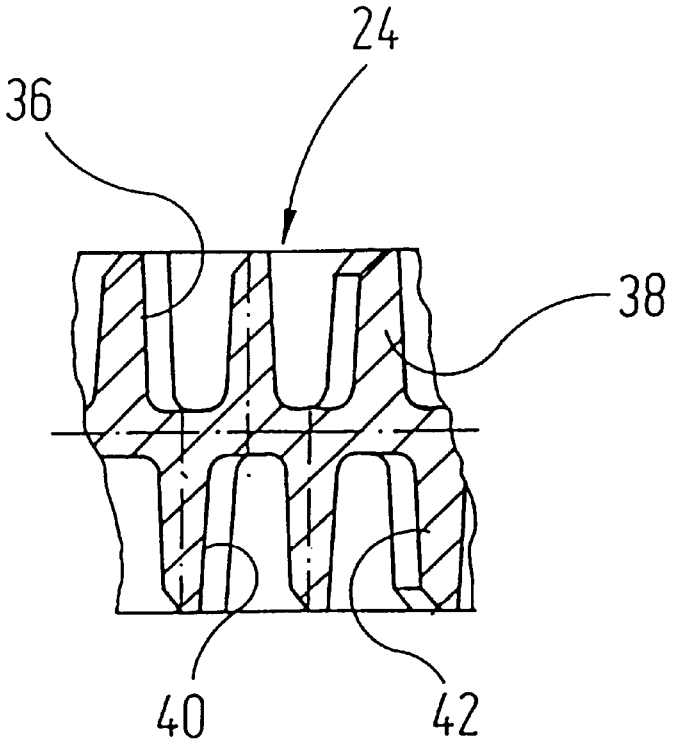
FIG. 5 is a section taken along a secant of the impeller, on an enlarged scale.

The impeller 24 has two plane-parallel end faces. Recesses 36 of rectangular shape, generously rounded at the corners and elongated in the middle and of semi-circular cross-section are cut into the upper end face of the impeller, in the edge region seen in a radial sectional view; side channel compressor blades 38 remain between the recesses. In alignment therewith, but offset by half a spacing, recesses 40 are cut into the edge region of the lower end face of the impeller 24, between which recesses side channel compressor blades 42 remain. As is apparent from FIG. 5, the trailing end of the end face of each compressor blade 38, seen in the direction of rotation, is constructed to recede at 45° obliquely with respect to the centre plane of the impeller 24.

A first side channel 44 is formed in the underside of the upper housing part 12 in alignment with the path of the compressor blades 38, the angular extent of which side channel (measured at its centre line running circumferentially) is approximately 330°. The side channel 44 has a radially obliquely outwardly running outlet section 46, which connects with an axial connecting channel 48 of the lower housing part 14 and leads to an inlet section 50 of a second side channel 52, which is provided in the upper face of the lower housing part 16 and aligns with the path of the compressor blades 42. The circumferential extent of the side channel 52 is again approximately 330°, as is evident from FIG. 3. An outlet section 54 of the side channel 52 connects with an outlet connector 56 of the lower housing part 16.

Webs 45 and 53 that remain between the ends of the side channels 44 and 52 respectively therefore have a circumferential extent of 30° (again measured at their radial centre). This angular extent can range between about 20° and about 40° in other exemplary embodiments. With this chosen angular extent of the webs 45 and 53, on the one hand the ends of the two side channels, which are under different pressures, can be sealed satisfactorily with respect to one another; on the other hand, a large circumferential extent of the side channels is achieved, which is advantageous with regard to generation of high pressure differences or great efficiency of the side channel machine.

Inserted in the outlet connector 56 is a sound absorber 58, which is surrounded by a sound absorption housing 60 having an outlet opening 62, indicated purely diagrammatically, which is connected to a vent pipe installed in the building.

Compressor blades 64 of a recompression stage, which are curved in the direction of rotation, are provided in a central region of the impeller 24 and are covered over by a curved rotationally symmetrical deflecting wall 66, the inlet side end section of which is axially parallel whilst the outlet side section of which is set at only a slight angle to a transverse plane. The lower end faces of the compressor blades 64 slope down from the edge inwardly to a hub section 68 of the impeller 24.

The inlet side end of the deflecting wall 66 is aligned with the upper edge of a conical inlet opening 70 of the housing that is provided in the base of the lower housing part 16. The inner face of the inlet opening 70 essentially represents a smooth continuation of a conically widened end portion of the inlet connection 18, which is placed over a seal 72 onto the lower housing part 12, thus forming a seal, and is there located with an axial edge portion 74 over a circular locating rib 76.

Axially above the outlet side ends of the compressor blades 64, a link channel 78 is provided in the underside of the upper housing part 12, the depth of which channel increases proportionally to its angular extent towards a coplanar connecting channel 80, which leads outwards to an inlet section 82 of the first side channel 44. The connecting channel 80 is connected to an axially parallel supplementary air channel 84, to which a supplementary air control unit 86 is connected, indicated diagrammatically in FIG. 1. Bypassing the recompression stage formed by the compressor blades 64, the control unit 86 can be used to supply supplementary air directly to the second inlet of the two-stage side channel compressor, which is formed by the compressor blades 38, 42 and the side channels 44, 52.

As is clear from the above description and also from FIG. 1, the compressor blades 64 provided in the central region of the impeller 24 enlarge neither the axial nor the radial dimensions of the suction machine. The housing of the suction machine consists only of two housing parts 12 and 16, which are easily manufactured by casting. A circumferentially extending upper wall 90 of the upper housing part 12, together with the covering wall of the housing part 12, forms a lower motor casing part. Projecting radially inwards from the wall 90 are locating ribs 92, which in the casting blank for the housing part 12 are oversized and are subsequently machined to end size so that they receive the stator 94 of the electric motor 28 with a positive fit. Because the locating ribs 92 are machined to different extents, the wall 90 is able to form a lower motor casing part for electric motors of different capacity.

Figure 2:
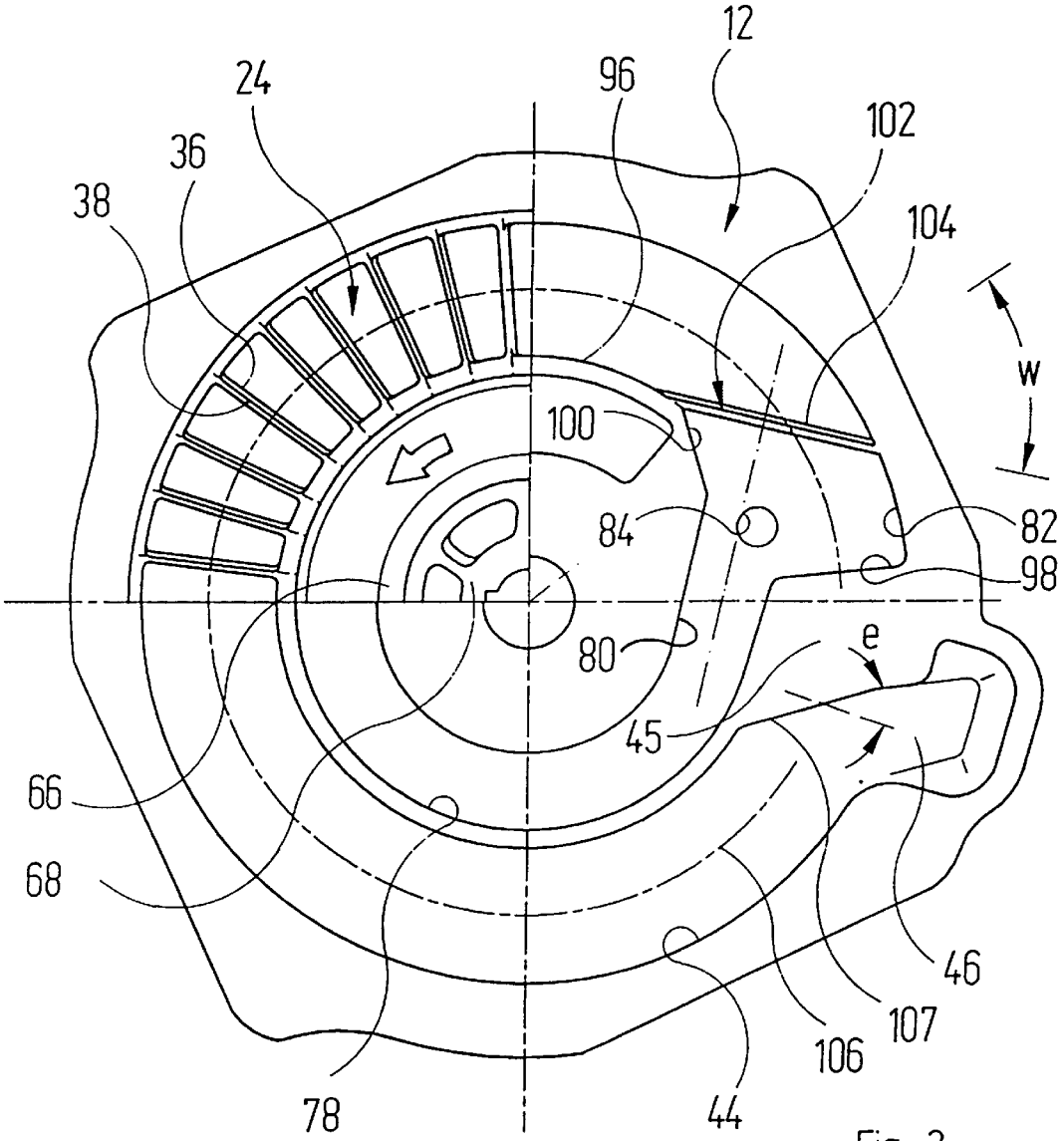
FIG. 2 is a plan view of the underside of an upper housing part of the suction machine according to FIG. 1, a plan view of the underside of the impeller additionally being shown in one quadrant.

As is apparent from FIG. 2, the connecting channel 80 opens into the radially inner limiting wall 96 of the inlet section 82 of the side channel 44. The angle at which it is set to this section of the limiting wall is about 60°, and the radially outer wall of the connecting channel 80 passes through the corner point that the radially inner limiting wall 96 would form with a rear limiting wall 98 of the inlet section 82 if the limiting wall 96 were continuous. The radially inner limiting wall of the connecting channel 80 opens via an oblique face 100, which widens the channel, into the radially inner limiting wall 96 of the side channel 44, forming an angle of about 30°.

A deflecting wall 102, which is narrow compared with the width of the impeller recesses, starts from the point at which the oblique face 100 meets the radially inner limiting wall 96 of the side channel 44, and forms an angle w of about 40° with respect to a radius line passing through its centre. At the same time the deflecting wall 102 stands substantially perpendicular to the longitudinal axis of the connecting channel 80.

The deflecting wall 102 is moulded with its lower end integrally with the base of the side channel 44 and extends with its end face exactly to the end face of the housing part 12. The downstream edge of the deflecting wall 102 is provided with a chamfer 104.

In continuous operation, pre-compressed air is admitted to the circumferentially extending link channel 78, as described above. The airflow delivered from the link channel 78 is able to spread out into the inlet section 82, and is also able to spread out by virtue of the oblique face 100. Because of the deflecting wall 102 the air flow is stalled and diverted upwards in a direction perpendicular to the plane of projection of FIG. 2 (that is, downwards in FIG. 1). The diverted air thus passes into the recesses 36 that are provided in the upper face of the impeller 24.

Since the deflecting wall 102 stands perpendicular to the longitudinal axis of the connecting channel 80, a good blocking effect is achieved. Since conversely the deflecting wall 102 is angled with respect to the graduated circle of the impeller marked with 106 and thus also with respect to the curved longitudinal axis of the side channel 44, channelling of the air flow is effected progressively, seen in the direction of rotation of the impeller. This asymmetrical arrangement of the deflecting wall 102 thus promotes the formation of a helical flow, as would occur in stationary operation of the side channel compressor only after rotation of the impeller 24 through a larger angle.

As is evident from the drawing, the circumferential extent of the deflecting wall 102 corresponds to the circumferential extent of approximately three successive recesses 40 (the same as three recesses 36).

Through better channelling of air from the link channel 80, an improved efficiency and better partial vacuum are obtained.

As shown in FIG. 2, a downstream end wall 107 of the side channel 44 is angled at an angle e to a radius line passing through its centre, which in the exemplary embodiment shown is 35°. In this way, the compressed air is drawn increasingly from the impeller and channelled in a radial direction.

In the exemplary embodiment described above, the setting angle w of the deflecting wall 102 was 40°. In practice, improvements over the state of the art were obtained with setting angles of between 20° and 50°, the range between 35° and 45°, especially 40°, yielding the best results.

Figure 3:
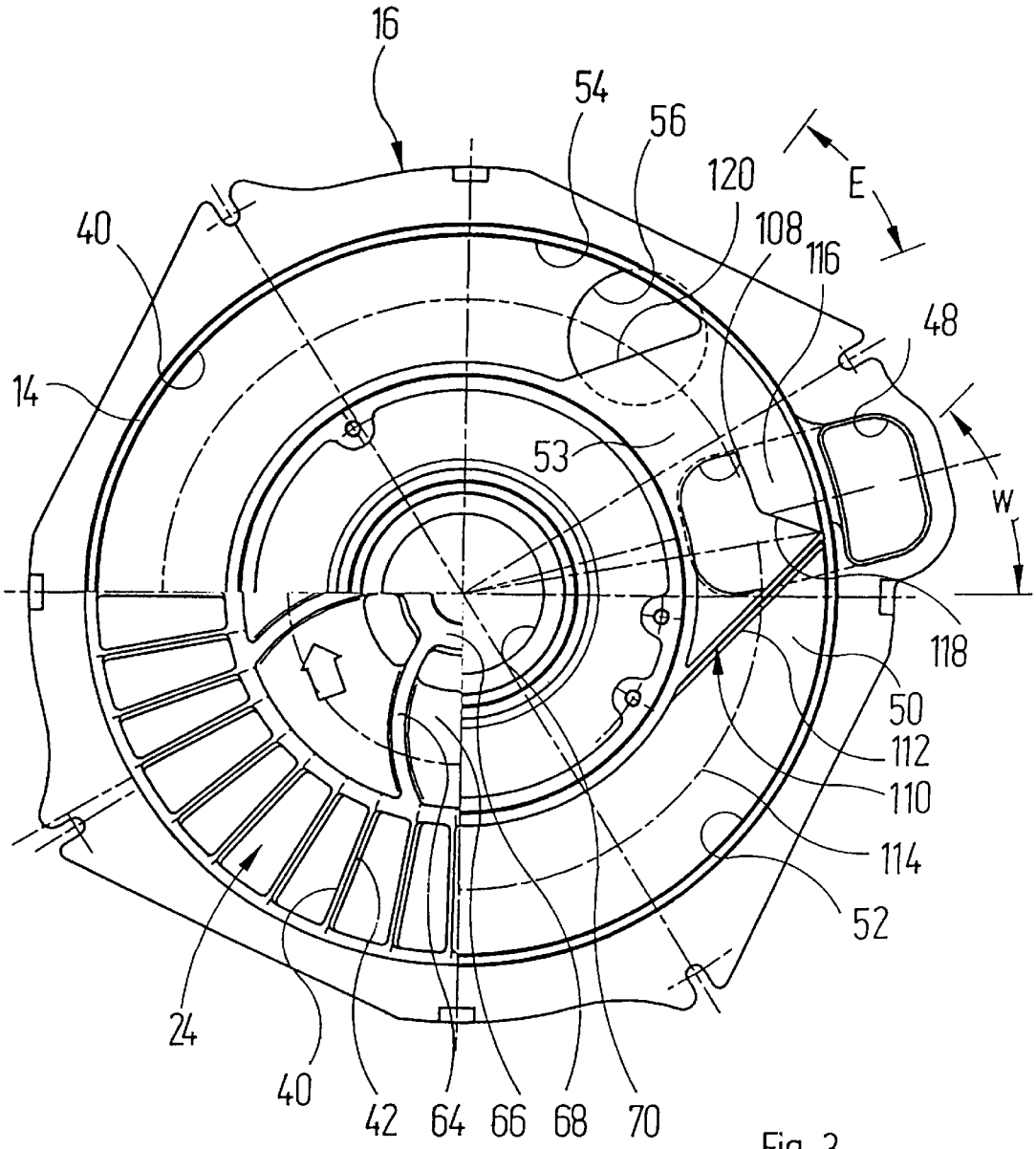
FIG. 3 is a plan view of the upper side of a lower housing part of the suction machine shown in FIG. 1, a plan view of the upper side of the impeller additionally being reproduced in one quadrant.
Figure 4:
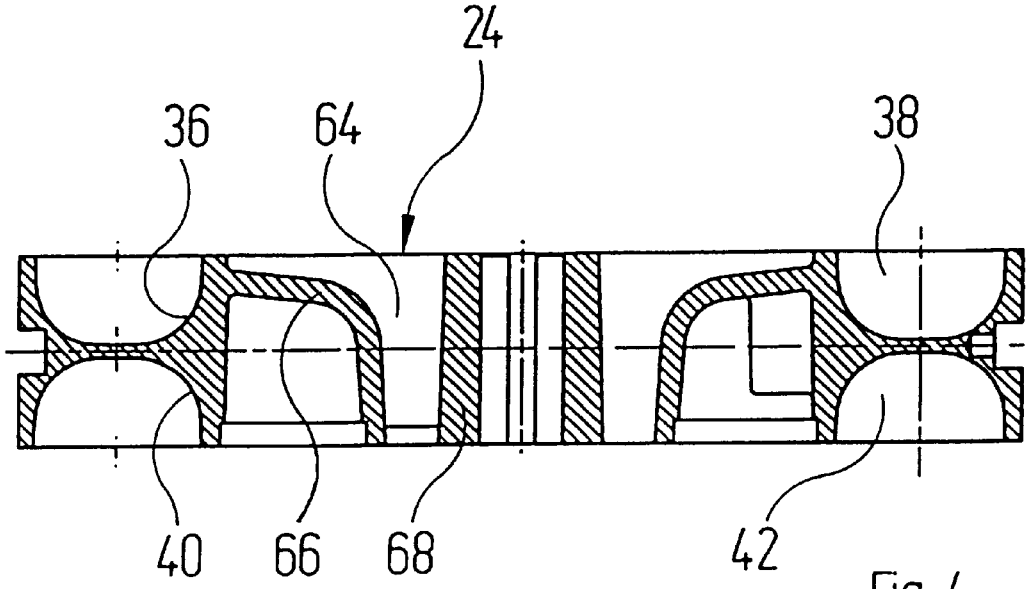
FIG. 4 is a radial section through the impeller of the suction machine shown in FIG. 1.

FIG. 3 shows a similar injection of the air to be conveyed into the inlet section 50 of the second compressor stage. The connecting channel 48 is connected to a radial channel section 108, which intersects with the end of the side channel 44 in a radially inward direction.

A deflecting wall 110 is set at an angle W with respect to a radius line passing through its centre. In the exemplary embodiment under consideration here this angle is equal to the angle w, that is, 40°. The upper end face of the deflecting wall 110 again has a downstream chamfer 112.

The point of intersection of the deflecting wall 110 and the graduated circle, denoted by the reference number 114, for the lower impeller recesses 36 and the lower side channel 52, lies slightly behind the downstream limiting wall of the channel section 108, seen in the direction of rotation. Approximately the upper third of the deflecting wall 110 thus roofs over the channel section 108, and in this region the wall of the side channel 52 is also continued without interruption as far as the deflecting wall 110.

That part of the channel section 108 that, seen in the direction of rotation, lies in front of the radial centre line of the channel section 108 and radially beyond the graduated circle 114, is roofed over by a web 116. From the longitudinal central plane of the channel section 108 the edge of the web 116 then continues in a straight line radially outwards to the outer end of the deflecting wall 106, as indicated at 118.

This construction of the transition between the channel section 108 and the side channel 52 likewise promotes a flow of air to the recesses 36 of the impeller 24 that is asymmetrical relative to the graduated circle 114. Added to that is the effect of the deflecting wall 110, which acts as a retaining dam that is asymmetrical relative to the graduated circle 114. The oblique leading edge 118 of the web 116 has proved beneficial with regard to good flow conditions and low noise generation.

The deflecting wall 110 again has a thickness that corresponds to the thickness of the compressor blades 38, 42 and is small compared with the width of the recesses, and again extends circumferentially over three recesses of the impeller.

As is also apparent from FIG. 3, the end wall 120 of the side channel 52 that lies at the front, seen in the direction of rotation, is inclined with respect to a radius line passing through its centre by an angle that in the drawing is denoted by the letter E. In the exemplary embodiment illustrated, this angle is about 35°. This assists extraction of air from the guide system formed by the impeller 24 and the side channel 52 and channelling thereof radially.

Figure 6:
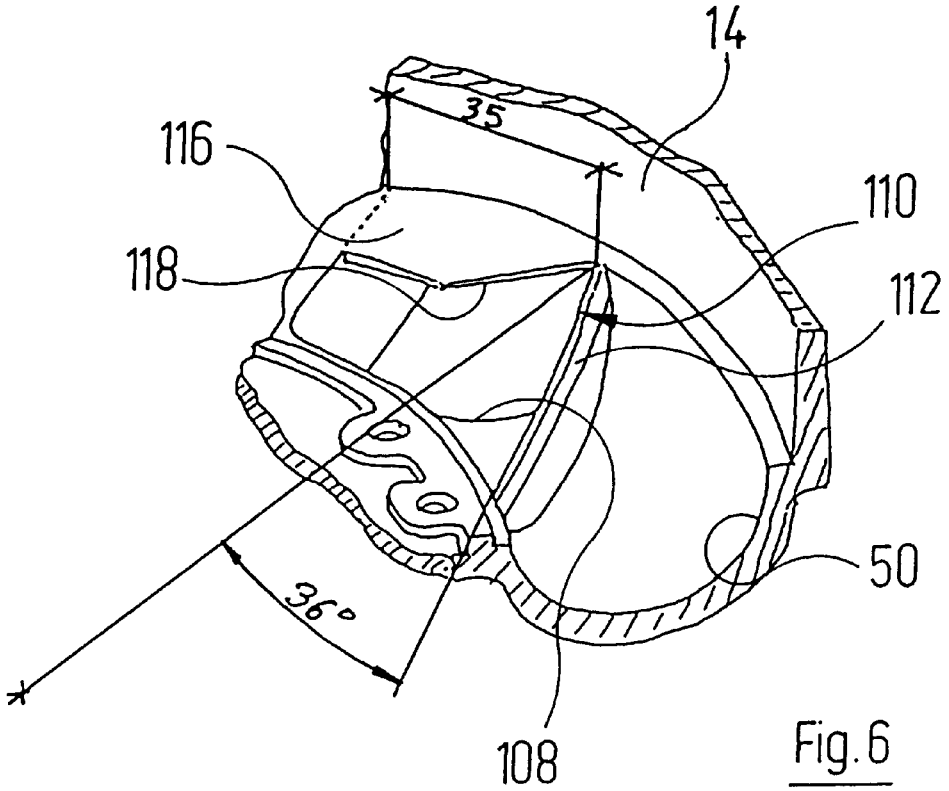
FIG. 6 is a perspective view of an inlet side end section of the side channel of the second stage of the suction machine.

FIG. 6 is a perspective view of the transition region between the inlet section 50 of the side channel 52 and the channel section 108 of the connecting channel 48. The web 116 is once more especially clear in this view.

Figure 7:
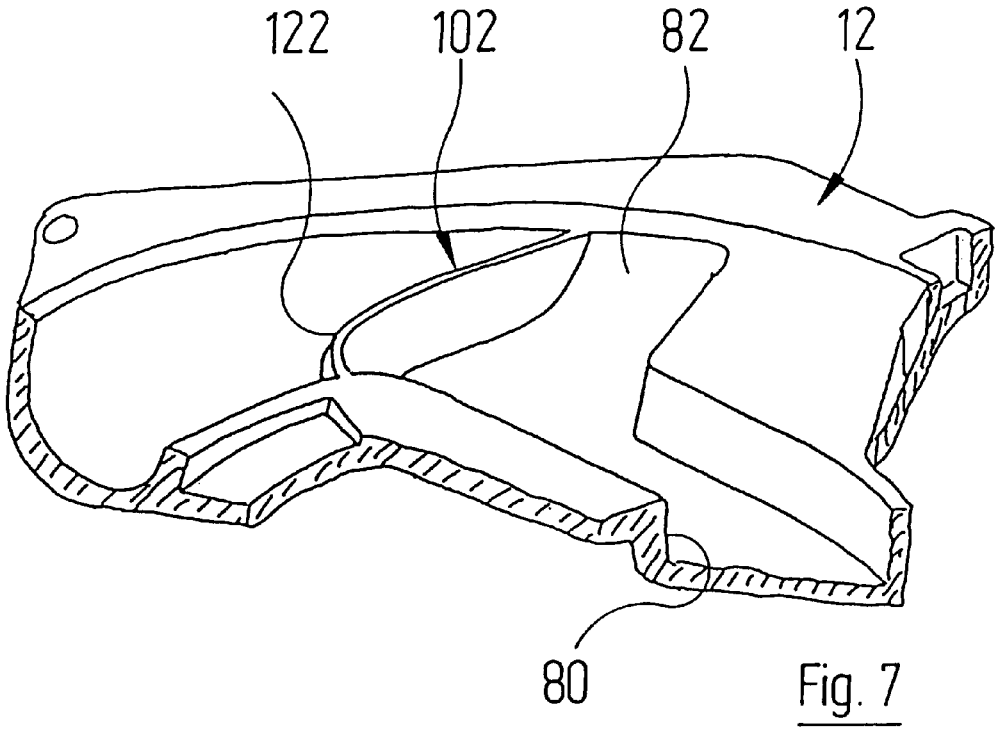
FIG. 7 is a perspective view of an inlet side section of the side channel of a first stage of the side channel suction machine shown in FIG. 1.

The exemplary embodiment according to FIG. 7 shows a modified transition point between the connecting channel 80 and the side channel 44 of the first compressor stage. The deflecting wall 102 now has a radially inner wall section 122 that is concavely curved, seen in the direction of rotation. The end of the wall section 122 coincides substantially with a radius line. This construction of the deflecting wall 102 enables an increased volumetric throughput to be achieved.

Figure 8:
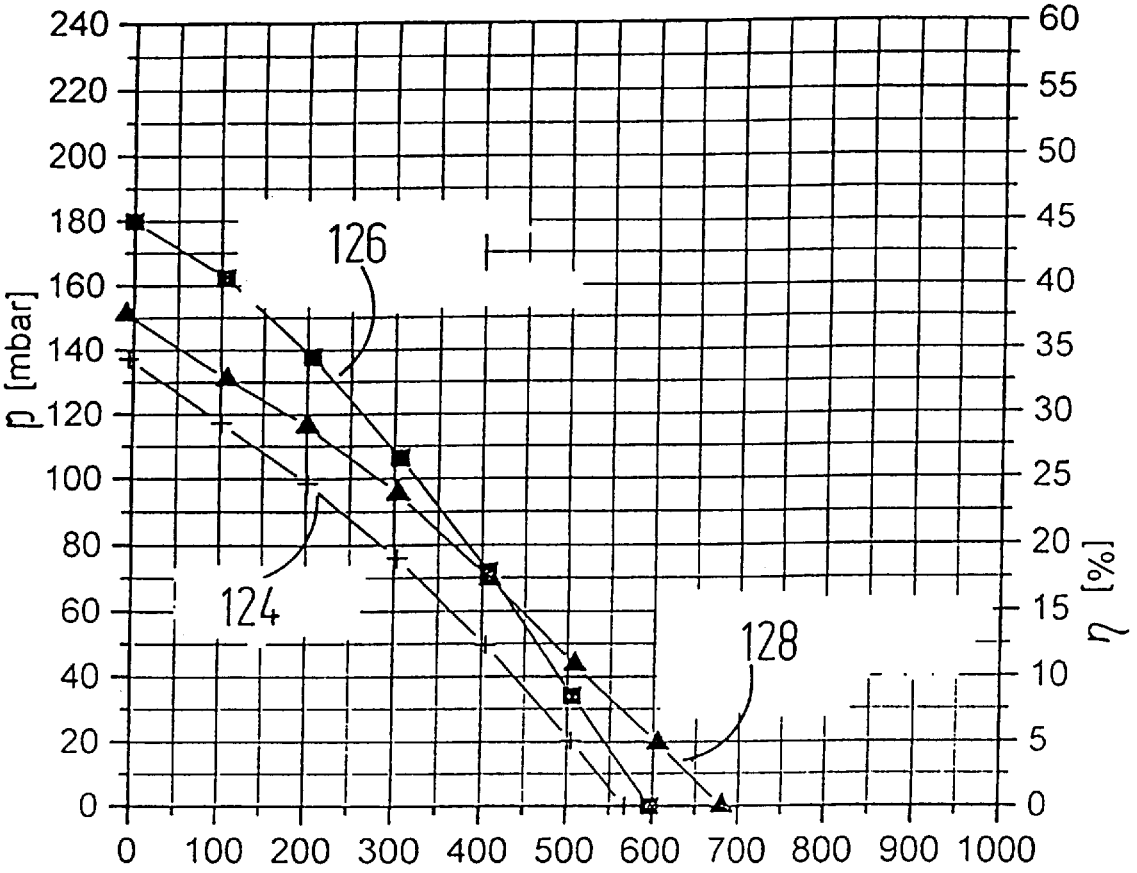
FIG. 8 is a diagram in which the partial vacuum that can be created with the side channel machine is plotted over the volumetric flow for practical embodiments of a suction machine according to the invention and a suction machine of the same dimensions according to the prior art mentioned in the introduction.

In FIG. 8, a curve 124 shows the partial vacuum plotted over the volumetric flow, as obtained with a side channel suction machine according to DE 41 28 150 A1.

A curve 126 corresponds to a side channel suction machine having the same dimensions, but in which the deflecting walls 102 and 110 were provided in the inlet sections of the side channels. A distinct improvement in the suction capacity is evident, and in efficiency, which can be read off on the right ordinate.

Side channel machines generally require a very small clearance between opposing surfaces moved with respect to one another. This causes high manufacturing costs. The curve 128 shows the operating characteristic of a side channel suction machine which corresponds to the suction machine used to obtain curve 126, the only difference being that the radial clearance was increased by 0.15 mm and the gaps were increased by 0.1 mm. It is evident that the capacity of this suction machine, which is much more cost-efficient to manufacture on account of the appreciably greater clearance, is still improved compared with the suction machine corresponding to curve 124 that serves as starting point and is more expensive to manufacture.

Figure 9:
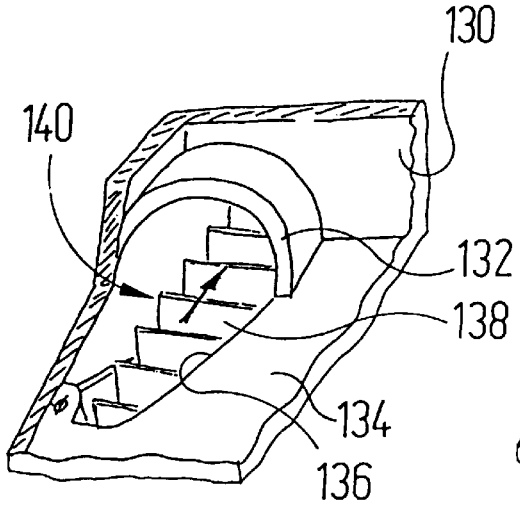
FIGS. 9 to 12 are perspective views of the inlet side end section of a side channel of different modified side channel suction machines.

In some side channel machines it is desirable for reasons associated with construction for the side channel to open into an inlet chamber of the housing. Such an inlet chamber is shown in FIG. 9 with the reference numeral 130. A semi-cylindrical wall 132 in the inlet chamber 130 represents a continuation of the side channel.

A base wall 134 of the inlet chamber 130 has an aperture 136, which is open towards the recesses 138 of an impeller 140.

If the aperture 136 is roofed over with a deflecting wall 142, which has the shape of a quarter of a truncated cone closed at the narrow end, as shown in FIG. 10, then air is again admitted asymmetrically to the recesses 138, which is necessary for rapid development of a helical toroidal flow.

Figure 10:
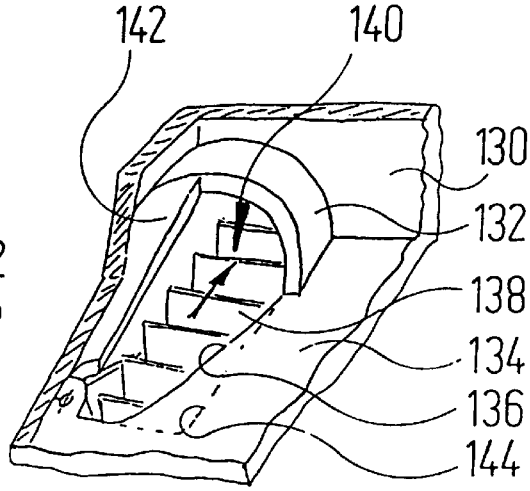

This asymmetry can be additionally reinforced in that the aperture 136 is enlarged in the unroofed region, as indicated in FIG. 10 by the broken line 144.

The effect of the deflecting wall 142 can be additionally intensified in a further step by mounting on the deflecting wall 142 a downwardly hanging deflecting wall 146, which follows substantially the graduated circle of the impeller.

Figure 12:
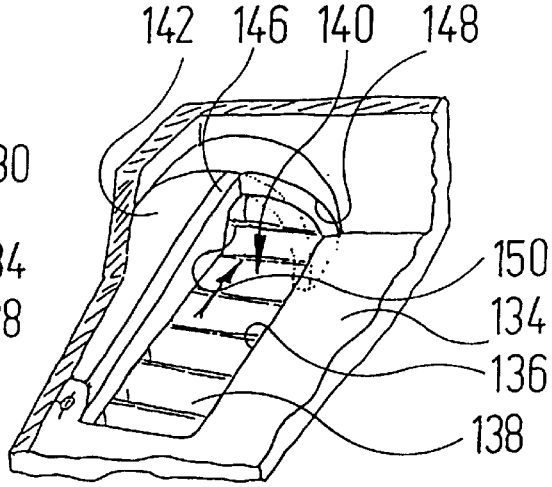

For additionally improved filling of the recesses 138, according to FIG. 12 the still exposed residual end face of the wall 132 can recede from top to bottom, seen in the direction of rotation, as indicated at 148, and the end of the deflecting wall 142 can be provided with a marginal aperture 150 opening downwards and in the direction of rotation.

Figure 11:
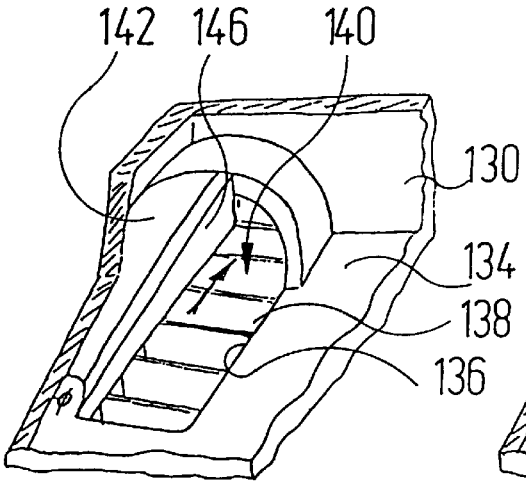

The deflecting wall arrangements according to FIGS. 10 to 12 also result in a marked improvement of the partial vacuum generated by the suction machine and of its efficiency.

What is claimed is:

1. A side channel machine having a rotating disc-shaped impeller, at least one end face of which has a plurality of recesses distributed circumferentially on a common pitch circle, having a housing, which comprises a working chamber receiving the impeller, wherein in end walls of the working chamber opposing the recesses of the impeller there are formed side channels overlying the paths of the recesses of the impeller, which side channels have an angular extent of less than 360°, so that between the end portions of the side channels there remain webs, and wherein each of the end portions of the side channels is connected to an inlet channel, the side channel machine also having a deflecting element that is asymmetrical with respect to the pitch circle of the recesses of the impeller and is arranged in an inlet side end portion of at least of one of the side channels, and wherein a radially inner portion of the deflecting element extends up to a radially inward side wall of said at least one side channel and a radially outer portion of the deflecting element extends up to a radially outward side wall of said at least one side channel and is concavely curved, seen in the direction of rotation of the impeller.

2. A side channel machine according to claim 1, wherein the deflecting element is a deflecting wall running perpendicular to the surface of the working chamber end wall.

3. A side channel machine according to claim 2, wherein the deflecting wall runs to the base of the side channel.

4. A side channel machine according to claim 2, the end face of the deflecting wall is led into the surface of the working chamber end wall.

5. A side channel machine according to claim 2, wherein the deflecting wall is set obliquely with respect to a radius line and is substantially uniform at least in a main portion.

6. A side channel machine according to claim 2, wherein the total circumferential extent of the deflecting wall corresponds to the circumferential extent of a plurality of recesses of the impeller.

7. A side channel machine according to claim 6, wherein the total circumferential extent of the deflecting wall corresponds substantially to the circumferential extent of 2 to 6 recesses of the impeller.

8. A side channel machine according to claim 2, wherein the deflecting wall as a small thickness compared with the circumferential extent of the recess of the impeller.

9. A side channel machine according to claim 8, wherein the thickness of the deflecting wall corresponds substantially to the thickness of the compressor blades of the impeller lying between adjacent recesses.

10. A side channel machine according to claim 1, wherein the deflecting element forms an angle of incidence of about 20° to about 50° with a radius line passing through its centre, the radially outer end of the deflecting element lying in front of the radially inner end, seen in the direction of rotation.

11. A side channel machine according to claim 10, wherein the angle of incidence lies between 30° and 45°.

12. A side channel machine according to claim 1, wherein the inlet side end section of at least one of the side channels is connected to an inlet chamber, is furthermore connected to the end face of the impeller by way of a connecting aperture that is formed in a working chamber end wall, and that a circumferentially running part of the connecting aperture is roofed over by a circumferentially running deflecting wall.

13. A side channel machine according to claim 1, wherein each of the webs remaining between the end sections of the side channels has an angular extent of 20° to about 40°, so that the side channels correspondingly have an angular extent of 340° to 320°.

14. A side channel machine according to claim 1, wherein the deflecting element forms an angle of incidence between 30° and 45° with a radius line passing through its centre, the radially outer end of the deflecting element lying in front of the radially inner end, seen in the direction of rotation.

15. A side channel machine according to claim 4, wherein a radially inner section of the deflecting element is concavely curved, seen in the direction of rotation of the impeller.

16. A side channel machine according to claim 6, wherein a radially inner foot section of the concavely curved wall section of the deflecting wall runs substantially radially.

17. A side channel machine according to claim 1, wherein the total circumferential extent of the deflecting element corresponds substantially to the circumferential extent of 2 to 6 recesses of the impeller.

18. A side channel machine according to claim 17, wherein the total circumferential extent of the deflecting element corresponds substantially to the circumferential extent of three recesses of the impeller.

19. A side channel machine having a rotating disc-shaped impeller, at least one end face of which has a plurality of recesses distributed circumferentially on a common pitch circle, having a housing, which comprises a working chamber receiving the impeller, wherein in end walls of the working chamber opposing the recesses of the impeller there are formed side channels overlying the paths of the recesses of the impeller, which side channels have an angular extent of less than 360°, so that between the end portions of the side channels there remain webs, and wherein each of the end portions of the side channels is connected to an inlet channel, the side channel machine also having a deflecting element that is asymmetrical with respect to the pitch circle of the recesses of the impeller and is arranged in an inlet side end portion of at least of one of the side channels, and wherein the inlet side end portion of at least one of the side channels is connected to an inlet chamber, is furthermore connected to the end face of the impeller by way of a connecting aperture that is formed in a working chamber end wall, and wherein a circumferentially extending part of the connecting aperture is roofed over by a circumferentially extending deflecting wall.

20. A side channel machine according to claim 19, wherein the deflect ing wall is in the form of a segment of a truncated cone that is connected at its base surface to the end of the side channel wall.

21. A side channel machine according to claim 19, wherein the radial extent of the deflecting wall corresponds approximately to half the radial extent of the connecting aperture.

22. A side channel machine according to claim 19, wherein the deflecting wall is closed at its end remote from the end of the side channel.

23. A side channel machine according to claim 19, wherein connected to the free longitudinal edge of the deflecting wall is a second deflecting wall, which approximately follows the graduated circle of recesses and stands perpendicular to the plane of the working chamber end wall.

24. A side channel machine according to claim 23, wherein the impeller-side end face of the second deflecting wall is led right into the plane of the working chamber end wall.

25. Side channel machine according to claim 23, wherein a marginal aperture is provided in the trailing end of the second deflecting wall, seen in the direction of rotation.

26. A side channel machine according to one of claim 23, wherein the inlet-side end of the side channel is formed by a semi-cylindrical wall drawn into the inlet chamber, and in the portion not joined to the deflecting wall this wall has an end face that recedes in the direction of rotation from the apex line of the side channel to the edge thereof.

27. A side channel machine according to claim 19, wherein the inlet aperture is substantially in the form of a rectangle with its long axis running in the direction of rotation.

* * * * *